US007614256B2

(12) United States Patent
Mitchell

(10) Patent No.: US 7,614,256 B2
(45) Date of Patent: Nov. 10, 2009

(54) BACK SUPPORTING BRASSIERE AND UNDERGARMENTS WITH REINFORCED ZONES AND METHOD OF MAKING THE SAME

(75) Inventor: John Mitchell, Asheboro, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 690 days.

(21) Appl. No.: 11/102,059

(22) Filed: Apr. 8, 2005

(65) Prior Publication Data

US 2006/0240743 A1 Oct. 26, 2006

(51) Int. Cl.
*A41B 9/16* (2006.01)

(52) U.S. Cl. ..... 66/179

(58) Field of Classification Search ..... 66/171, 66/176, 177, 175, 169 R, 170, 182
See application file for complete search history.

(56) References Cited

U.S. PATENT DOCUMENTS

| | | | | |
|---|---|---|---|---|
| 3,425,246 | A * | 2/1969 | Knohl | 66/171 |
| 3,489,154 | A | 1/1970 | Kaspar etal. | |
| 3,710,801 | A | 1/1973 | Bienenfeld | |
| 3,728,873 | A | 4/1973 | Titone | |
| 3,895,003 | A | 7/1975 | Swain et al. | |
| 4,499,741 | A | 2/1985 | Harris | |
| 4,531,525 | A | 7/1985 | Richards | |
| 4,564,015 | A | 1/1986 | Friedman | |
| 4,909,771 | A | 3/1990 | Bergman | |
| 4,911,677 | A | 3/1990 | White | |
| 4,976,653 | A | 12/1990 | White | |
| 5,221,227 | A | 6/1993 | Michels | |
| 5,378,192 | A | 1/1995 | Darmante | |
| 5,385,502 | A | 1/1995 | Moretz et al. | |
| 5,441,436 | A | 8/1995 | Moretz et al. | |
| 5,444,995 | A | 8/1995 | Benetton | |
| 5,479,791 | A * | 1/1996 | Osborne | 66/171 |
| 5,553,468 | A * | 9/1996 | Osborne | 66/171 |
| 5,590,548 | A | 1/1997 | Osborne | |
| 5,592,836 | A * | 1/1997 | Schuster et al. | 66/176 |
| 5,605,060 | A | 2/1997 | Osborne | |
| 5,850,745 | A * | 12/1998 | Albright | 66/176 |
| 5,855,124 | A | 1/1999 | Donaghy et al. | |
| 5,946,944 | A | 9/1999 | Osborne | |
| 5,996,120 | A * | 12/1999 | Balit | 2/67 |
| 6,023,785 | A | 2/2000 | Johnson | |
| 6,099,382 | A | 8/2000 | Wilson | |
| 6,125,664 | A | 10/2000 | Browder | |
| 6,192,717 | B1 * | 2/2001 | Rabinowicz | 66/177 |
| 6,272,888 | B1 * | 8/2001 | Fujita et al. | 66/172 E |

(Continued)

*Primary Examiner*—Danny Worrell
(74) *Attorney, Agent, or Firm*—Womble Carlyle Sandridge & Rice, PLLC

(57) ABSTRACT

A circular knit brassiere is provided. The brassiere has a back panel, a front panel preferably having a pair of breast cups and preferably having a pair of shoulder straps. The back panel has at least one reinforced zone. Preferably, the breast cups, shoulder straps, and the central gore also have reinforced zones. Preferably, the reinforce zones are formed during the knitting process, and also preferably using positive float miss stitch construction combinations and added in yarns. The brassiere also preferably has true or mock terry stitch construction on the wearer facing fabric side of the reinforced zones, for providing moisture wicking properties. The reinforced zones of the present invention can also be knitted into garments such as shapewear, maternity wear and athletic wear.

52 Claims, 5 Drawing Sheets

U.S. PATENT DOCUMENTS

| | | | | |
|---|---|---|---|---|
| 6,287,168 | B1 * | 9/2001 | Rabinowicz | 450/75 |
| 6,332,825 | B1 | 12/2001 | Henricksen | |
| 6,336,840 | B2 | 1/2002 | Heroff | |
| 6,645,041 | B2 * | 11/2003 | Søslashed.rensen | 450/36 |
| 6,886,367 | B2 * | 5/2005 | Mitchell et al. | 66/176 |
| RE38,853 | E * | 10/2005 | Rabinowicz | 450/75 |
| 7,017,376 | B2 * | 3/2006 | Meckley et al. | 66/171 |
| 7,043,942 | B2 * | 5/2006 | Chapman | 66/177 |
| 7,051,557 | B2 * | 5/2006 | Mitchell et al. | 66/179 |
| 7,163,432 | B2 * | 1/2007 | Mitchell et al. | 450/65 |
| 2002/0022433 | A1 | 2/2002 | Yeung et al. | |

* cited by examiner

BACK SUPPORTING BRASSIERE AND UNDERGARMENTS WITH REINFORCED ZONES AND METHOD OF MAKING THE SAME

BACKGROUND OF THE INVENTION

1. Field of the Invention

The present invention relates to brassieres or bras and methods of making same. More particularly, the present invention relates to a circular knit brassiere having a reinforced engineered construction at the back of the brassiere.

2. Description of the Related Art

Traditional brassieres provide shaping effect as well as support to the breasts, thereby reducing movement of the breasts during activity. The additional support provided by a brassiere increases the comfort of the wearer. Athletic style brassieres satisfy a particular need for increased support during physical activity. Athletic style brassieres have evolved to incorporate a host of additional features.

Circular knit brassieres have become popular for the comfort and flexibility that they provide. Circular knit technology has been used to create brassieres that accommodate a need for stretchability and freedom of movement. This circular knitting process itself offers efficient and cost effective manufacturing. However, circular knit brassieres provide only limited support during activity.

Therefore, a need exists for a method of manufacturing circular knit brassiere, preferably an athletic brassiere, having a panel, such as a back panel that is strengthened with reinforced zones, unlike known circular knit brassieres.

SUMMARY OF THE INVENTION

It is an object of the present invention to provide a seamless circular knit brassiere or bra having reinforced zones for providing added strength to a desired panel, preferably, a back panel, of the brassiere.

It is another object of the present invention to provide a back supporting brassiere having reinforced zones for providing added strength to the back panel and shoulder strap areas of the brassiere.

It is yet still another object of the present invention to provide a back supporting brassiere having reinforced zones for providing added strength to the brassiere that are formed during the knitting process of the brassiere.

It is yet another object of the present invention to provide a back supporting brassiere in which a reinforced zone of restricted stretchability is created using positive float miss stitch construction and spliced-in additional yarns.

It is yet still another object of the present invention to provide such a back supporting brassiere in which a reinforced zone imparts a low vertical walewise stretch with increased modulus and density.

It is still yet another object of the present invention to provide such a back supporting brassiere in which the reinforced zone imparts a low coursewise stretch with increased modulus and density.

It is a further object of the present invention to provide a back supporting brassiere having either a positive float mock terry or a true sinker terry knitted into the wearer fabric side of the brassiere for providing moisture wicking properties.

It is still a further object of the present invention to provide a back supporting brassiere having either a positive float mock terry or a true sinker terry knitted into the wearer fabric side of the brassiere for providing hydrophilic properties.

It is yet still a further object of the present invention to provide a method of making a seamless circular knit back supporting bra or brassiere and/or blank, having a pair of front and rear straps formed through knitting in the upper torso to define an armhole and neckline, and having at least one reinforced zone to provide added strength in the back panel of the brassiere.

It is a yet further object of the present invention to provide a method of making a seamless circular knit back supporting brassiere that incorporates integrally knitted-in, selectively placed reinforced zones in the back, breast cup, central gore and shoulder areas, an integrally knit anchoring chest band, and a mock or true terry in the reinforced zones, preferably for providing moisture wickability and hydrophilic capabilities, thereby reducing the number of steps in the manufacturing process.

It is still yet a further object of the present invention to provide other garments such as panties and/or briefs, maternity garment, shapewear, or active athletic wear that incorporates integrally knitted-in, selectively placed reinforced zones knitted using a mock or true terry stitches in the reinforced zones preferably for providing, in addition to support, moisture wickability and hydrophilic capabilities.

These and other objects and advantages of the present invention are achieved by a brassiere formed from a circular knit bra blank that is cut to define a traditionally shaped sports bra body. The body has at least one knitted-in reinforced zone of support formed at the brassiere back. This knitted-in reinforced zone is preferably created by using a positive float miss stitch construction and knitted-in yarn. The brassiere also preferably has knitted-in reinforced zones in the breast cup and shoulder strap areas. The brassiere preferably has an anchoring chest band, a stabilizing central gore, and a front closure. The brassiere further preferably has positive float mock terry or true sinker terry stitch construction knitted-in to the wearer's side of one or more reinforced zones. This mock terry or true sinker terry stitch construction preferably provides one or more, and preferably all of the following benefits, namely, comfort, enhanced support, increased padding and moisture wickability and hydrophilic capability.

BRIEF DESCRIPTION OF THE DRAWINGS

The foregoing and still other objects and advantages of the present invention will be more apparent from the following detailed explanation of the preferred embodiments of the present invention in connection with the accompanying drawings.

DETAILED DESCRIPTION OF THE INVENTION

Figure 1:
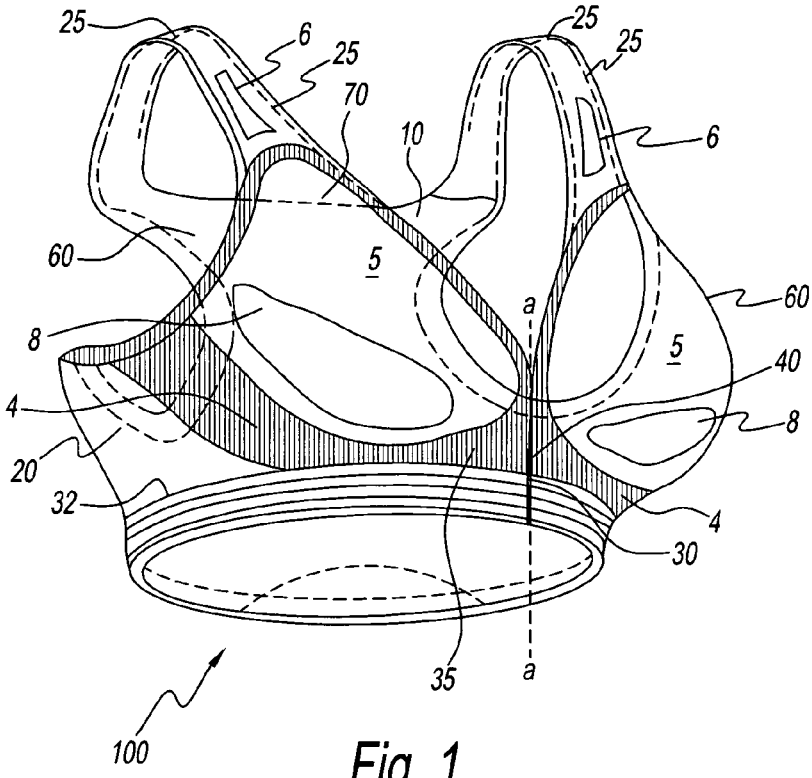
FIG. 1 is a front perspective view of a brassiere of a preferred embodiment according to the present invention.

Referring to the drawings and, in particular, FIG. 1, there is illustrated a bra or brassiere according to the present invention generally represented by reference numeral 100. Brassiere 100 is preferably formed from a single layer of fabric. However, brassiere 100 may have two or more layers of fabric.

According to the present invention, a bra blank is formed on a circular knitting machine, preferably having a computerized electronic needle and yarn feed selection system. The knit construction of the body of the brassiere 100 may be formed using one or any combination of conventional knit stitches. Such stitches include, but are not limited to, plain, tuck or float stitches.

The bra blank is a cylindrical shaped blank from which a brassiere 100 may be cut. In one embodiment of the present invention, the brassiere 100 is formed by a method of folding an integral first brassiere layer and a second brassiere layer from a single blank, about an anchoring chest band. In an alternate embodiment of the present invention, several brassieres are formed from a single blank, according the method disclosed in U.S. application Ser. No. 10/444,513, filed on May 5, 2003, incorporated herein by reference.

Figure 2:
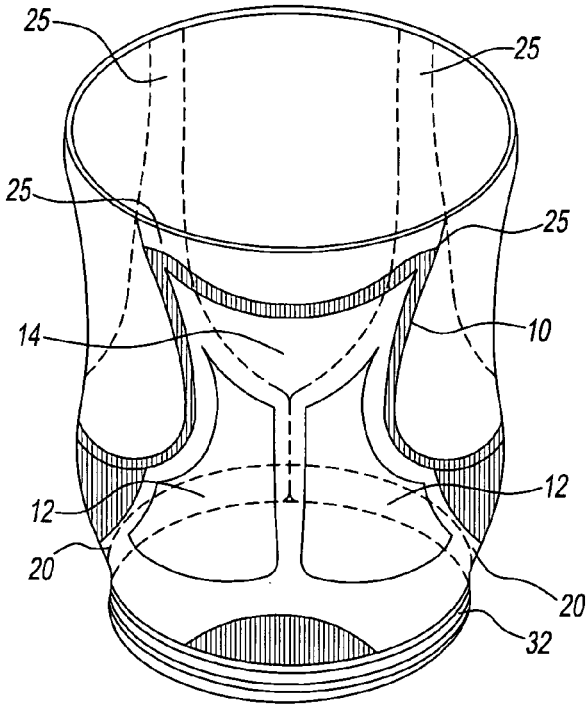
FIG. 2 is a rear perspective view of the brassiere of FIG. 1.

The outline of brassiere 100 is cut from the bra blank preferably using a sewing machine that simultaneously cuts away and finishes the periphery of brassiere 100 to form a back panel 10. Further, brassiere 100 has side panels 20 as shown in FIG. 2, a front panel 60 that preferably has a pair of breast cups 5 as shown in FIG. 1, and preferably a pair of shoulder straps 25. In the preferred embodiment, brassiere 100 also has an anchoring chest band 30 and a central gore 35. In the most preferred embodiment of the present invention, brassiere 100 is a front opening brassiere so that it has a front closure or fastener 40.

Figure 3:
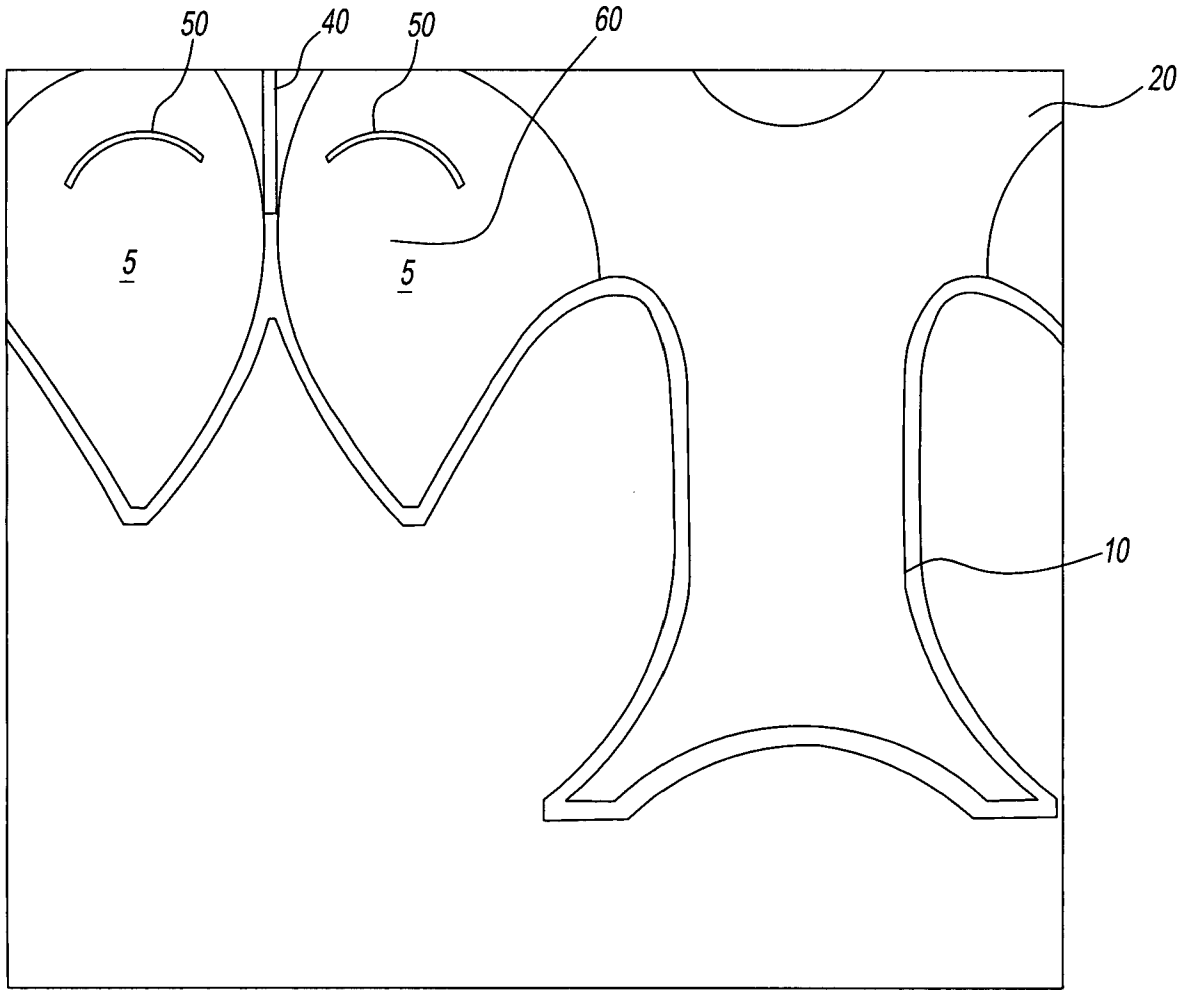
FIG. 3 is a schematic plan view of the blank of the brassiere of FIG. 1 upside down.

In the preferred embodiment, back panel 10 forms a yoke 14 that includes side panels 20 and covers the entire back panel 10 of brassiere 100. Yoke 14 is a strengthened area that covers the wearer's back and sides, as shown in FIGS. 2 and 3. Yoke 14 has reinforced zones 12 to provide added strength to brassiere 100 and to enhance support to the wearer in the lumbar spine region of the back. However, it should be noted that back panel 10 may be have discrete reinforced zones 12 placed in strategic locations that cover only a portion of back panel 10 of brassiere 100 to produce support effect. In this embodiment, reinforced zones 8 are also preferably placed in breast cups 5 to provided added support to the breast tissue. Additionally, a reinforced zones 4 are also provided to central gore 35 between the bottom of breast cups 5 and anchoring chest band 32. Further, reinforced zones 6 are also provided at shoulder straps 25 to strengthen straps for supporting the breasts.

At back panel 10, reinforced zones include, but are not limited to, a Y-shaped yoke design following the line of the wearer's spine and two angular support areas that stretch from the wearer's spine to shoulder straps 25, a cross design, a T-shaped design, or a modified yoke design.

Reinforced zones 4, 6, 8 and 12 are preferably formed using positive float miss stitch construction combinations. Supplemental yarns are also preferably spliced-into the reinforced zones 4, 6, 8 and 12 during the knitting process. The terry stitches may be formed of a hydrophilic yarn such as those made from natural fibers or staple or textured continuous filament synthetic fibers. Such yarns include, but are not limited to, cotton, textured microdenier nylon, or a synthetic continuous multifilament textured nylon having substantial wickable moisture properties. The positive float miss stitch construction combinations and supplemental yarns reduce the stretchability in the reinforced zones, yielding a fabric that resists stretching. The fabric in the reinforced zones 4, 6, 8 and 12 has a lower vertical walewise stretch and increased modulus, as well as a lower width coursewise stretch with increased coursewise modulus. The added in yarn is preferably a textured continuous filament nylon or cotton yarn, although other yarns could be used.

Additional reinforced zones may be formed by varying stitch type, density and length. For example, terry loop construction limits the stretchability of the fabric and provides added support and reinforcement. Additionally, the terry loop construction offers additional padding and bulk to the brassiere in the reinforced zones 4, 6, 8 and 12.

The strengthened areas, such as breast cups 5 and back panel 10, may have varying degrees of stretchability for producing increased support and shaping effect in specific zones, as well as gradations of support in specific zones 8 and 12, respectively. Such varying degrees of stretchability are achieved by varying stitch density and stitch length in the areas where the positive float miss stitch is employed. U.S. patent application Ser. No. 10/729,836, filed on Dec. 4, 2003, which describes a method for forming areas of varying stitch density, is incorporated herein by reference.

In the most preferred embodiment of the back support brassiere of the present invention, which is shown in all of the figures, breast cups 5 are releasably joined together at the front of the wearer by a fastener 30. Fastener 30 may be any conventional fastener, such as, for example, zipper, hook-and-eye, snap, and Velcro closures. Fastener 30 may be adjustable to accommodate the size of the wearer. However, while not preferred, brassiere 100 may lack a fastener. For example, brassiere 100 may be slipped over the head of the wearer in the manner of traditional sports bras.

Brassiere 100 preferably has a pair of shoulder straps 25. While not preferred, the shoulder straps 25 may be adjustable. Each shoulder strap 25 is connected at a first end to a different one of a pair of breast cups 5, and at a second end to back panel 10. Shoulder straps 25 may have, in addition to reinforced zones 6, inserts for relieving stress to the wearer's shoulder. Such inserts may be formed of foam, silicone gel, water or other similar material.

Brassiere 100 preferably also has an anchoring chest band 30 disposed at the bottom margin of the brassiere. Preferably, anchoring chest band 15 is a turned welt integrally knitted and seamlessly joined to the bottom edge of brassiere 100 during the circular knitting process in a well-known manner. Alternatively, anchoring chest band 15 could have a folded edge disposed at the bottom margin of the brassiere.

Central gore 35 is formed in the area between breast cups 5, and provides stabilizing support to the front portion of brassiere 100. In the preferred embodiment, fastener 30 is at the center of center gore 35 along line a-a of FIG. 1. Central gore 35 may be formed as a reinforced zone using positive float miss stitching, or may be strengthened by varying the stitch type or density, or by adding yarns during the knitting process in a well known manner.

Brassiere 100 may also have an underwire 50 for providing additional support to the breast as shown in FIG. 3. Underwire 50 may be an arcuate shaped wire, which is disposed in a wire channel secured, preferably sewn to brassiere 100. Alternatively, underwire 50 may be formed of a heat shrinkage yarn formed to be a support. In a multi-layer embodiment of the present invention, underwire 50 may be sandwiched between layers of brassiere 100 and secured to breast cups 5 by sewing, gluing or other fastening means.

Brassiere 100 may have a terry loop integrally stitched to the brassiere for providing softness, comfort, moisture wicking and hydrophilic properties. The terry loop is integrally stitched to the wearer's side 60 of brassiere 100, such that the outward facing side 70 has the smooth fabric face desired in a brassiere.

The terry loop is preferably formed by splicing-in additional yarns to the wearer's side 60 of brassiere 100 during the knitting process. The terry loop is preferably formed using a true sinker terry loop stitch construction or a positive float mock terry loop stitch construction. The terry loop may also include a combination of a mock terry loop and true terry loop stitch construction.

The terry loop construction is advantageously incorporated into athletic brassieres to provide functional benefits. The terry stitches may be formed of a hydrophilic yarn, such as those made from natural fibers or staple or textured continuous filament synthetic fibers. Such yarns include, but are not limited to, cotton, textured microdenier nylon, or a synthetic continuous multifilament textured nylon having substantial wickable moisture properties. The combination of the moisture wicking and hydrophilic properties enable brassiere 100 to pull moisture away from the body surface to expedite evaporation. Antimicrobial yarns that are knitted together with the wickable and hydrophilic yarns limit bacterial proliferation that produces odor and the destruction of the fabric.

Figure 4:
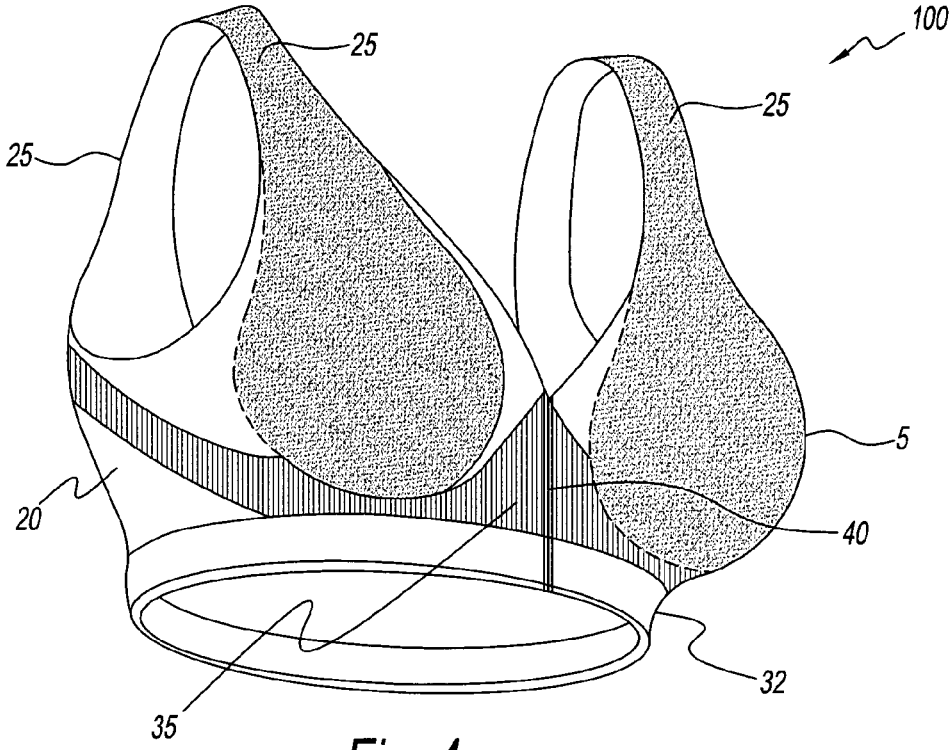
FIG. 4 is a front perspective view of the brassiere of FIG. 1 showing terry areas.

The terry loop construction may also be integrally stitched to selected portions of the wearer's side of brassiere in reinforced zones 4, 6, 8 and 12, such as, for example, central gore 35, shoulder straps 25, breast cups 5 or back panel 10, respectively. For example, FIG. 4 shows the terry loop knit stitch construction knitted-in the breast cup areas 5 of brassiere 100. Alternately, the terry loop may cover the entire brassiere 100. It is conceivable that in a multi-layer embodiment of the present invention, the terry loop may be sandwiched between a first, outer fabric layer and a second, inner fabric layer.

To provide aesthetic and recognizable characteristics to a finished brassiere 100, the blank may have knitted-in patterns on breast cups 5 and on back panel 10. Such decorations may include, but are not limited to, floral, ribbed, geometric, abstract or other designs.

The blank is formed by a knitting a series of circular knit courses. The courses for anchoring chest band 30 may include a course program that has predominately plain knit stitches, or, alternately may employ combinations of a plain knit and miss-stitch or float stitch construction. In this construction, loops on specified needles in specified courses are held without additional yarns being taken on those certain needles and then knit into subsequent courses, thereby gathering the courses together to form anchoring chest band 32. The areas of brassiere 100 that do not have reinforced stitch construction are formed mostly with simple knit constructions, such as plain, tuck, miss, float, or any combinations thereof.

To manufacture brassiere 100, a blank is formed on a circular knitting machine. Blank 100 is preferably formed to include shoulder straps 25 to define an armhole and neckline. During the knitting process, reinforcement zones 12 are stitched into back panel 10 and other specific areas. The reinforced zones 12 are preferably stitched using positive float miss stitch construction combinations and spliced in textured continuous filament nylon or cotton yarn. Also during the knitting process, additional yarns may be spliced into reinforced zones 12 on the wearer facing side of brassiere 100 using either positive float mock terry knit construction or true sinker terry knit construction. The brassiere 100 is then cut from the knitted blank and finished in any manner known in the art. Shoulder straps 25 are then joined, for example, by tacking.

Figure 5A:
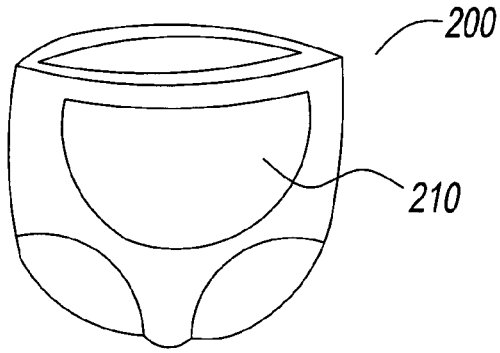
FIG. 5*a* is a front perspective view of a second embodiment of the invention showing reinforced zones.
Figure 5B:
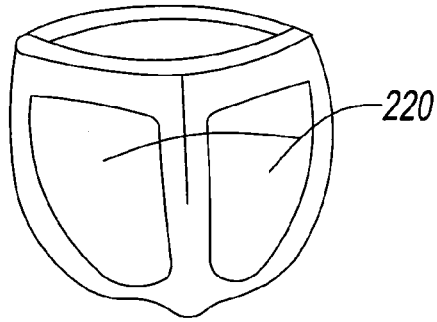
FIG. 5*b* is a rear plan view of the embodiment of FIG. 5*a*, showing reinforced zones.

Referring to FIGS. 5*a* and 5*b*, panty 200, according to the second embodiment, is shown. Panty 200 incorporates reinforced zones 210 and 220 at the front and back of panty 200, respectively. Zone 210 is for controlling the stomach region of the wearer. Zone 220 is for controlling and lifting the buttocks of the wearer. Panty 200 can be worn for either everyday or special occasion wear. Similar to the stitching of the first embodiment, the second embodiment reinforced zones 210 and 220 are knitted using positive float miss stitch construction and spliced-in additional yarns to create a restricted stitch construction of limited stretchability. While a panty is shown in FIGS. 5*a* and 5*b*, a man's brief could also incorporate reinforced zones in similar locations to those of panty 200 for similar advantages.

Figure 6A:
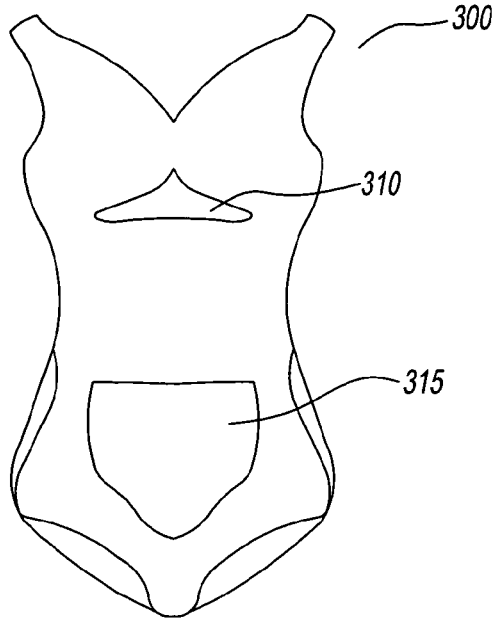
FIG. 6*a* is a front plan view of a third embodiment of the present invention, showing reinforced zones.
Figure 6B:
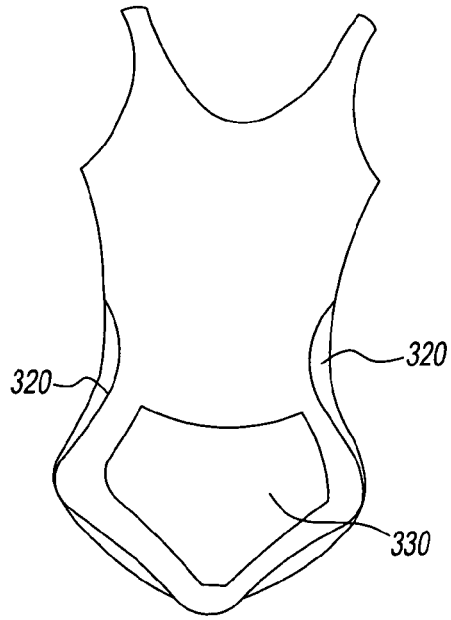
FIG. 6*b* is a rear plan view of the embodiment of FIG. 6*a*, showing reinforced zones.

Referring to FIGS. 6*a* and 6*b*, shapewear bodysuit 300, according to the third embodiment, is shown. Bodysuit 300, at the front of the garment, incorporates reinforced zone 310 and reinforced zone 315. Zone 310 is for controlling and lifting the bust region of the wearer. Zone 315 for controlling the stomach and stomach muscles of the wearer. Zones 320 are located at the sides of the garment to shape the waist and hips of the wearer. At the back of bodysuit 300, reinforced zone 330 is for controlling and lifting the buttocks of the wearer. Bodysuit 300 is particularly suited for special occasion wear or formal wear beneath garments to flatter the figure of the wearer. The stitching of the third embodiment reinforced zones are knitted using positive float miss stitch construction and spliced-in additional yarns to create a restricted stitch construction of limited stretchability.

Figure 7A:
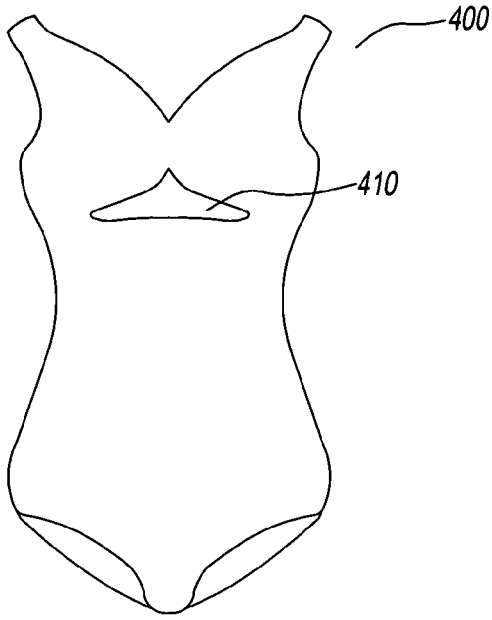
FIG. 7*a* is a front plan view of a fourth embodiment of the present invention, showing reinforced zones.
Figure 7B:
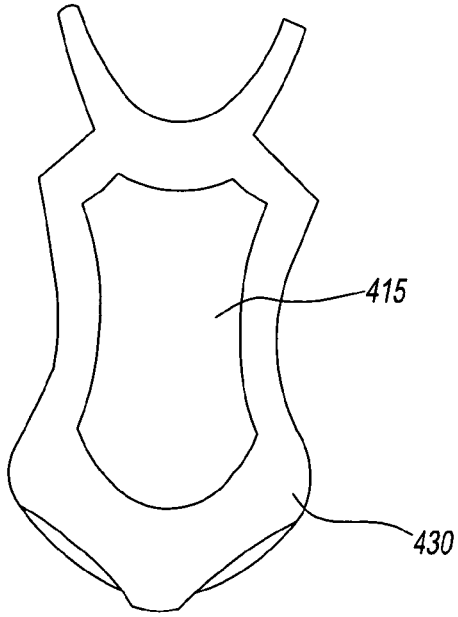
FIG. 7*b* is a rear plan view of the embodiment of FIG. 7*a*, showing reinforced zones.

Referring to FIGS. 7*a* and 7*b*, athletic suit 400, according to the fourth embodiment, is shown. Athletic suit 400, at the front of the garment, incorporates reinforced zone 410 for controlling and supporting the bust region of the wearer. At the back of athletic suit 400, reinforced zone 415 is for controlling and supporting the back and lumbar spine region of the wearer. Athletic suit 400 is particularly adapted for gymnastic or aerobic activity. Reinforced zones 410 and 415 are knitted using positive float miss stitch construction using true or mock terry stitching and spliced-in additional yarns to create a restricted stitch construction of limited stretchability. The terry stitches may be formed of a hydrophilic yarn, such as those made from natural fibers or staple or textured continuous filament synthetic fibers. Such yarns include, but are not limited to, cotton, textured microdenier nylon, or a synthetic continuous multifilament textured nylon having substantial wickable moisture properties. The combination of the moisture wicking and hydrophilic properties enable the brassiere to pull moisture away from the body surface to expedite evaporation. Antimicrobial yarns that are knitted together with the wickable and hydrophilic yarns limit bacterial proliferation that produces odor and the destruction of the fabric. While a bodysuit is shown in the fourth embodiment; a similar garment could also be used for supporting the back and/or abdomen and bust of a pregnant or nursing woman.

While an athletic suit is shown in the fourth embodiment, other athletic wear such as rugby or football wear could be knitted with the reinforced stitching of the present invention in selected zones, such as the genital region, to provide support and/or protection to the wearer.

The present invention has been described with particular reference to the preferred embodiments. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A circular knit brassiere comprising:

a front panel having a pair of breast cups;

a back panel having a torso encircling direction, the back panel having at least one non-reinforced zone and at least one knitted-in reinforced zone; and the at least one reinforced zone formed by a positive float miss stitch construction, wherein the at least one reinforced zone has a modulus in the torso encircling direction greater than the modulus of the at least one non-reinforced zone.

2. The brassiere of claim 1, wherein said knitted-in reinforced zone is formed using said positive float miss stitch construction in combination with added-in yarns.

3. The brassiere of claim 1, wherein said reinforced zone comprises a positive float mock terry construction on the wearer facing fabric side.

4. The brassiere of claim 1, wherein said reinforced zone comprises a true sinker stitch terry construction on the wearer facing fabric side.

5. The brassiere of claim 1, further comprising an integrally knit anchoring chest band.

6. The brassiere of claim 5, wherein said chest band is a turned welt or a folded edge.

7. The brassiere of claim 1, further comprising a pair of shoulder straps.

8. The brassiere of claim 7, wherein each of said pair of shoulder straps has a knitted-in reinforced zone.

9. The brassiere of claim 8, wherein said knitted-in reinforced zones of said pair of shoulder straps are formed using positive float miss stitch construction combinations.

10. The brassiere of claim 8, wherein said knitted-in reinforced zones of said pair of shoulder straps are formed using a positive float miss stitch construction in combination with added-in yarns.

11. The brassiere of claim 8, wherein said knitted-in reinforced zones of said pair of shoulder straps comprise a positive float mock terry construction on the wearer facing fabric side.

12. The brassiere of claim 8, wherein said knitted-in reinforced zones of said pair of shoulder straps comprise a true sinker stitch terry construction on the wearer facing fabric side.

13. The brassiere of claim 1, further comprising a pair of side panels, each of said pair of side panels connecting said back panel to a different one of said pair of breast cups.

14. The brassiere of claim 1, further comprising a central gore.

15. The brassiere of claim 1, wherein each of said pair of breast cups has at least one knitted-in reinforced zone.

16. The brassiere of claim 15, wherein said knitted-in reinforced zones of said pair of breast cups are formed using positive float miss stitch construction combinations.

17. The brassiere of claim 15, wherein said knitted-in reinforced zones of said pair of breast cups are formed using positive float miss stitch construction combinations and added in yarns.

18. The brassiere of claim 15, wherein said knitted-in reinforced zones of said pair of breast cups comprise a positive float mock terry construction on the wearer facing fabric side.

19. The brassiere of claim 15, wherein said reinforced zones of said pair of breast cups comprise a true sinker stitch terry construction on the wearer facing fabric side.

20. The brassiere of claim 1, further comprising a fastener between said pair of breast cups.

21. The brassiere of claim 20, wherein said fastener is one selected from the group consisting of a zipper, a hook-and-eye fastener, and a snap.

22. A circular knit brassiere comprising:

a front panel having a pair of breast cups;

a back panel having a torso encircling direction, the back panel having:

a pair of side panels, each of said pair of side panels being connected to a different one of said pair of breast cups at least one non-reinforced zone and at least one knitted-in reinforced zone;

the at least one reinforced zone formed by a positive float miss stitch construction, wherein the at least one reinforced zone has a modulus in the torso encircling direction greater than the modulus of the at least one non-reinforced zone;

an anchoring band at a bottom margin of the brassiere;

a pair of shoulder straps, each of said pair of shoulder straps connecting said back panel to a different one of said pair of breast cups; and a central gore being disposed between said pair of breast cups.

23. The brassiere of claim 22, further comprising a fastener positioned in said central gore for releasably connecting together said pair of breast cups.

24. The brassiere of claim 22, wherein each of said pair of breast cups has at least one knitted-in reinforced zone.

25. The brassiere of claim 24, wherein each of said pair of shoulder straps has a knitted-in reinforced zone.

26. The brassiere of claim 25, wherein said reinforced zones of each of said pair of breast cups and each of said pair of shoulder straps are formed using positive float miss stitch construction combinations.

27. The brassiere of claim 25, wherein said reinforced zones of the back panel, each of said pair of breast cups, and each of said pair of shoulder straps are formed using positive float miss stitch construction combinations and added in yarns.

28. The brassiere of claim 24, wherein at least one reinforced zone of each of said pair of breast cups further comprise a positive float mock terry construction on the wearer facing fabric side.

29. The brassiere of claim 24, wherein at least one reinforced zone of each of said pair of breast cups further comprise a true sinker stitch terry construction on the wearer facing fabric side.

30. A method of making a circular knit brassiere, the method comprising:

forming a seamless circular knit blank having a torso encircling direction, the blank having a back panel, a front panel having a pair of breast cups, a pair of shoulder straps for connecting said back panel to said pair of breast cups, and an anchoring chest band;

forming at least one non-reinforced zone and at least one knitted-in reinforced zones in said back panel, each of said pair of breast cups, and each of said pair of shoulder straps and the at least one reinforced zone in said back panel, each of said pair of breast cups, and each of said pair of shoulder straps formed by a positive float miss stitch construction, wherein the at least one reinforced zone in said back panel, each of said pair of breast cups, and each of said pair of shoulder straps has a modulus in the torso encircling direction greater than the modulus of the at least one non-reinforced zone in said back panel, each of said pair of breast cups, and each of said pair of shoulder straps.

31. The brassiere of claim 30, wherein said reinforced zones are formed using positive float miss stitch construction combinations and added in yarns.

32. The brassiere of claim 30, wherein said reinforced zones further comprise a positive float mock terry construction on the wearer facing fabric side.

33. The brassiere of claim 30, wherein said reinforced zones further comprise a true sinker stitch terry construction on the wearer facing fabric side.

34. A circular knit garment comprising:

a front panel; and a back panel having a torso encircling direction, the back panel having at least one non-reinforced zone and at least one knitted-in reinforced zone; and the at least one reinforced zone formed by a positive float miss stitch construction, wherein the at least one reinforced zone has a modulus in the torso encircling direction greater than the modulus of the at least one non-reinforced zone.

35. The circular knit garment of claim 34, wherein said front panel has at least one knitted-in reinforced zone.

36. The garment of claim 35, wherein said at least one knitted-in reinforced zone of said front panel is formed using positive float miss stitch construction combinations.

37. The garment of claim 35, wherein said at least one knitted-in reinforced zone of said back panel and said front panel are formed using positive float miss stitch construction combinations and added in yarns.

38. The garment of claim 35, wherein said at least one knitted-in reinforced zone of said front panel and said back panel comprise a positive float mock terry construction on the wearer facing fabric side.

39. The garment of claim 35, wherein said at least one knitted-in reinforced zone comprises a true sinker stitch terry construction on the wearer facing fabric side.

40. The garment of claim 34, wherein said front panel and said back panel are circularly knit to form a panty.

41. The garment of claim 40, wherein said back panel has two knitted-in reinforced zones.

42. The garment of claim 34, wherein said front panel and said back panel are circularly knit to form a shapewear bodysuit.

43. The garment of claim 42, wherein said front panel has four reinforced zones.

44. The garment of claim 43, wherein said one of said four reinforced zones is located in a breast-receiving area of said bodysuit, a second of said four reinforced zones is located in a stomach area of said bodysuit, and a third and a fourth of said four reinforced zones are located at the sides of said bodysuit.

45. The garment of claim 42, wherein said back panel has a reinforced zone in the buttocks-covering area of the bodysuit.

46. The garment of claim 35, wherein said front panel and said back panel are circularly knit to form athletic wear.

47. The garment of claim 46, wherein said athletic wear is selected from the group consisting of gymnastic wear, aerobic wear, football wear, soccer wear and rugby wear.

48. The garment of claim 47, wherein said back panel has a reinforced zone in the lumbar spine region of the garment.

49. The garment of claim 47, wherein said front panel has a reinforced zone in the genital-covering region of the garment.

50. The garment of claim 46, wherein said reinforced zones are knitted using hydrophilic and anti-microbial yarns.

51. A circular knit garment comprising:

a front panel and a back panel are circularly knit to form a shapewear bodysuit;

the back panel having at least one non-reinforced zone and plurality of knitted-in reinforced zones; and the plurality of reinforced zones formed with a positive float miss stitch construction, wherein the plurality of-reinforced zones have a modulus greater than the at least one non-reinforced zone in at least one of the walewise and coursewise direction;

wherein one of the plurality of reinforced zones is located in a breast-receiving area of the bodysuit, a second of the plurality reinforced zones is located in a stomach area of the bodysuit, and a third and a fourth of the plurality of reinforced zones are located at the sides of the bodysuit.

52. A circular knit brassiere comprising:

a front panel having a pair of breast cups;

a back panel having a walewise and coursewise direction, the back panel having at least one non-reinforced zone and at least one knitted-in reinforced zone; and the at least one reinforced zone formed by a positive float miss stitch construction, wherein the at least one reinforced zone has a modulus in at least one of the walewise and coursewise direction greater than the modulus of the at least one non-reinforced zone.

* * * * *